US005522361A

United States Patent [19]

Pickman et al.

[11] Patent Number: 5,522,361

[45] Date of Patent: Jun. 4, 1996

[54] THROTTLE SHAFT SEAL FOR A THROTTLE BODY

[75] Inventors: David C. Pickman, Chelmsford, England; Donald M. Lawrence, Redford, Mich.

[73] Assignee: Ford Motor Company, Dearborn, Mich.

[21] Appl. No.: 524,499

[22] Filed: Sep. 7, 1995

[51] Int. Cl.[6] ..... F02D 9/10

[52] U.S. Cl. ..... 123/336; 123/337; 251/305

[58] Field of Search ..... 123/336, 337, 123/403; 251/305, 306

[56] References Cited

U.S. PATENT DOCUMENTS

| | | | |
|---|---|---|---|
| 3,974,806 | 8/1976 | Nohira | 261/1 |
| 4,660,996 | 4/1987 | Marshall | 384/138 |
| 5,092,296 | 3/1992 | Gunter et al. | 123/337 |
| 5,181,492 | 1/1993 | Sausner et al. | 123/337 |
| 5,188,078 | 2/1993 | Tamaki | 123/403 |
| 5,370,361 | 12/1994 | Mendell et al. | 251/305 X |

FOREIGN PATENT DOCUMENTS

| | | |
|---|---|---|
| 410871 | 1/1991 | European Pat. Off. . |
| 1-262333 | 10/1989 | Japan . |
| 3-107549 | 5/1991 | Japan . |
| 6-17675 | 1/1994 | Japan . |

*Primary Examiner*—Tony M. Argenbright
*Attorney, Agent, or Firm*—Donald A. Wilkinson; Roger L. May

[57] ABSTRACT

A throttle body (10) for use in the air intake system of an internal combustion engine. The throttle body (10) includes a throttle body housing (12) having throttle shaft bearings (22) mounted within it for receiving a throttle shaft (34). The throttle shaft (34) is mounted within the bearings (22) and coupled to a throttle position sensor (26), which is mounted to the throttle body (10). The throttle shaft (34) includes mounting surfaces (40) aligned with the bearings (22) and a sealant (42) applied between the mounting surfaces (40) and the bearings (22) to both seal the intersection between the two and to substantially eliminate axial movement of the throttle shaft (34) relative to the throttle shaft bearings (22).

15 Claims, 2 Drawing Sheets

THROTTLE SHAFT SEAL FOR A THROTTLE BODY

FIELD OF THE INVENTION

The present invention relates to throttle bodies that are employed to regulate the flow of intake air into an internal combustion engine, and more particularly to the throttle shafts that support and actuate the valve within the throttle body.

BACKGROUND OF THE INVENTION

Conventional throttle bodies are mounted within the intake air stream of an internal combustion engine. Typically, a butterfly valve is employed to control the amount of air flow though the throttle body. The butterfly valve is mounted on a throttle shaft, which is in turn coupled to the vehicle accelerator pedal, and possibly other actuating mechanisms.

The air intake system operates most accurately when there is no air leakage in the system. With minimal leakage, mass air flow sensors, which are also mounted in the air intake stream, will obtain more accurate readings of the air flowing into the engine, which, in turn, allows an on-board computer to operate the engine at peak efficiency.

One potential source of leakage is around the throttle shaft where it mounts to the throttle body housing. In order to maintain smooth rotation of the throttle shaft, bearings are typically employed that mount to the shaft and are fixed to the housing. But the need to seal around the throttle shaft still exists. Some designs do not do anything about the leakage and just allow the resultant inaccuracy to occur. Other designs employ rubber seals that mount adjacent to the bearings around the surface of the throttle shaft, but these seals can wear and create a drag on the shaft causing resistance to smooth rotation of the shaft. Although, having seals avoids the problems with leakage, especially the inconsistency of leakage from one car to another.

Still other designs employ O-rings mounted within a circumferential groove formed in the shaft at the locations of the bearings with the O-rings mounting between the shaft and bearings to seal between the two. The design maintains ease of assembly and also keeps costs to a minimum. However, the groove in the throttle shaft also weakens the shaft itself, requiring a slightly larger diameter for the same applied forces. A minimum throttle shaft diameter is desirable to save weight and cost. Therefore, a desire exists to allow for easy and cost efficient assembly of a throttle shaft to bearings in a throttle body while sealing the space between the throttle shaft and the bearings, but not weakening the throttle shafts or interfering with smooth rotation of the shaft.

A further concern that arises with throttle shafts is that they typically mount, at one end, to a throttle position sensor. Since the throttle shafts must be free to rotate relative to the throttle body housing, they typically have play in an end-to-end (axial) direction. In order to account for this play, the throttle position sensor must be more complex and expensive because it generally needs additional bushings, springs and seals to account for this. Thus a desire exists to limit the end-to-end free play, allowing for the employment of a less expensive sensor, while still allowing for free rotation and good sealing around the throttle shaft.

SUMMARY OF THE INVENTION

In its embodiments, the present invention contemplates a throttle body for use in an air intake system of an internal combustion engine. The throttle body includes a throttle body housing having an air flow bore and a throttle shaft mounting bore therethrough. Bearings are mounted within the throttle shaft mounting bore, and a throttle shaft, having a mounting surface thereabout, is aligned with at least one of the bearings. Sealing means are located between the mounting surface and the at least one of the bearings, for filling any gap that may exist between the mounting surface and the corresponding bearing and for substantially eliminating axial movement between them.

Accordingly, an object of the present invention is to use sealing compound to seal the throttle shaft to bearings mounted to the throttle body housing to allow for smooth rotation of a throttle shaft relative to a throttle body while providing for sealing around the throttle shaft where it mounts to the housing, without substantially reducing the strength of the throttle shaft.

An advantage of the present invention is that the intersection of the throttle shaft to the bearings in the throttle body housing is sealed, to prevent leakage, allowing for a more accurate sensing of the volume of air entering the engine.

A further advantage of the present invention is that the axial play of the throttle shaft relative to the housing is substantially eliminated, allowing for the use of a throttle position sensor that does not have to be designed to account for this play.

An additional advantage of the present invention is that the sealing compound can be applied accurately at a high rate of production speed and automated, thus reducing manufacturing costs.

DETAILED DESCRIPTION OF THE PREFERRED EMBODIMENTS

Figure 1:
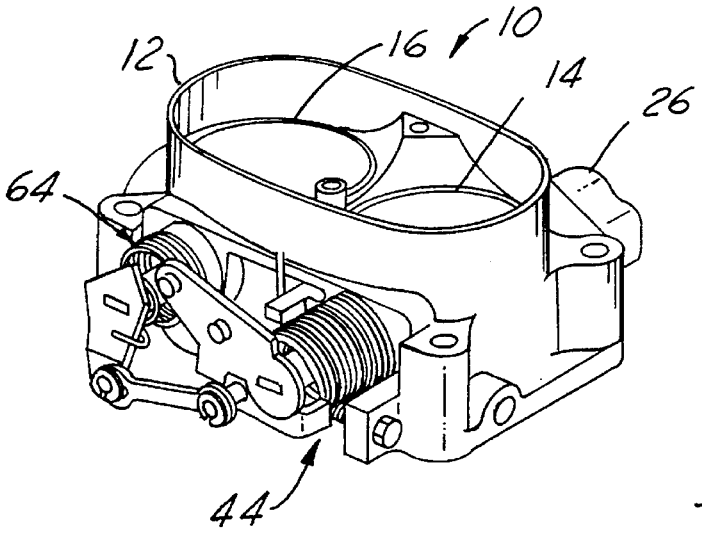
FIG. 1 is a general perspective view of a throttle body for an internal combustion engine in accordance with the present invention.
Figure 3:
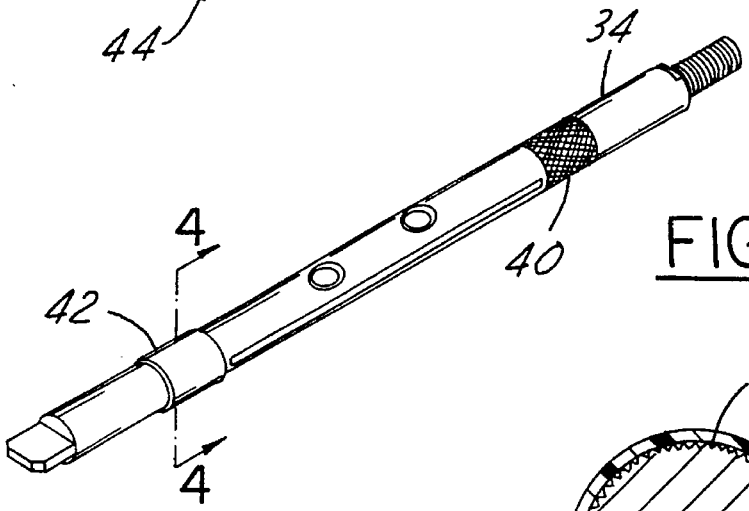
FIG. 3 is a perspective view, on an enlarged scale, of one of the throttle shafts, with one of the surfaces illustrating the coating of sealing compound.
Figure 4:
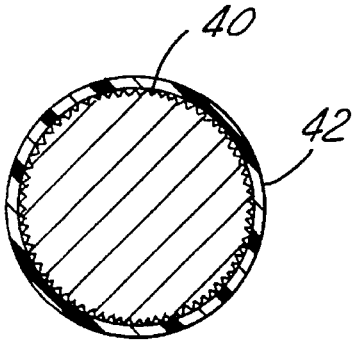
FIG. 4 is a section cut, on an enlarged scale, taken along line 4—4 in FIG. 3.

A throttle body assembly 10 includes a throttle body housing 12, which assembles into an air intake system for an internal combustion engine, not shown. The throttle body housing 12 disclosed in this preferred embodiment includes two air flow bores, a primary air flow bore 14 and a secondary air flow bore 16 through which intake air is directed during operation of the internal combustion engine. The throttle body housing 12 also includes a pair of throttle shaft bores, a primary throttle shaft bore 18 and a secondary throttle shaft bore 20. The primary throttle shaft bore 18 intersects and is generally normal to the axis of the primary air flow bore 14, and the secondary throttle shaft bore 20 intersects and is generally normal to the axis of the secondary air flow bore 16.

Within the primary throttle shaft bore 18 are mounted a pair of throttle shaft bearings 22, one on each side of the primary air flow bore 14. Within the secondary throttle shaft bore 20 are mounted a second pair of throttle shaft bearings 24, one on each side of the secondary air flow bore 16. A throttle position sensor 26 and gasket 28 are mounted, by screws 30, to throttle body housing 12 adjacent to one of the throttle shaft bearings 22 mounted in primary throttle shaft bore 18. An expansion plug 32 is mounted to throttle body housing 12 adjacent to one of the throttle shaft bearings 24 mounted in the secondary throttle shaft bore 20.

A primary throttle shaft 34 is sized to fit within the pair of bearings 22, with one end of the shaft mating with the throttle position sensor 26. The primary throttle shaft 34 includes a central slotted portion for receiving a primary throttle plate 36, affixed with screws 38. The primary throttle shaft 34 also includes a pair of mounting surfaces 40, each one aligned to mount within a corresponding one of the bearings 22. The mounting surfaces 40 are shown with knurls on them, although splines or a rough ground surface can also be used for this surface that mounts within the throttle shaft bearings 22. The other end of the primary throttle shaft 34 is coupled to a primary throttle spring 46, a primary throttle control lever 48 and attachment hardware 62 in a conventional fashion, forming a primary throttle shaft assembly 44.

A sealing compound 42 is applied on the mounting surfaces 40 and hardens between the primary throttle shaft 34 and throttle shaft bearings 22, filling in any gap between the two. This seals the throttle shaft 34 to the bearings 22. The knurls on the mounting surface 40 give the sealing compound 42 a better grip on the throttle shaft 34, than if it were a smooth surface, as is the case with conventional throttle shafts.

The sealing compound 42 is one which will provide sealing and locking properties while being used in a vehicle engine compartment environment. An example of a typical primary throttle shaft 34 might have a width of knurled area of about 7 mm, with the knurl being a diamond knurl at a 96 diametrical pitch and a minimum depth of 0.1 mm after finish grinding and plating the main surface of the throttle shaft 34; the shaft 34 being between about 6 and 10 mm in diameter. Examples of sealing compounds that can be used are DRI-LOC 204 ™ manufactured by Locktite Corporation, or Scotch-Grip 2510™ by 3M Company of St. Paul Minn.

The sealing compound 42 will also keep the throttle shaft 34 from moving in an axial direction. By holding the throttle shaft 34 from axial movement, in addition to preventing leakage, a less complex, and thus, less expensive throttle position sensor 26 can be used that does not need to be able to account for axial play. For example, a throttle position sensor such as a 526 SERIES model by CTS Corporation of Elkhart, Ind. can be used.

Figure 2:
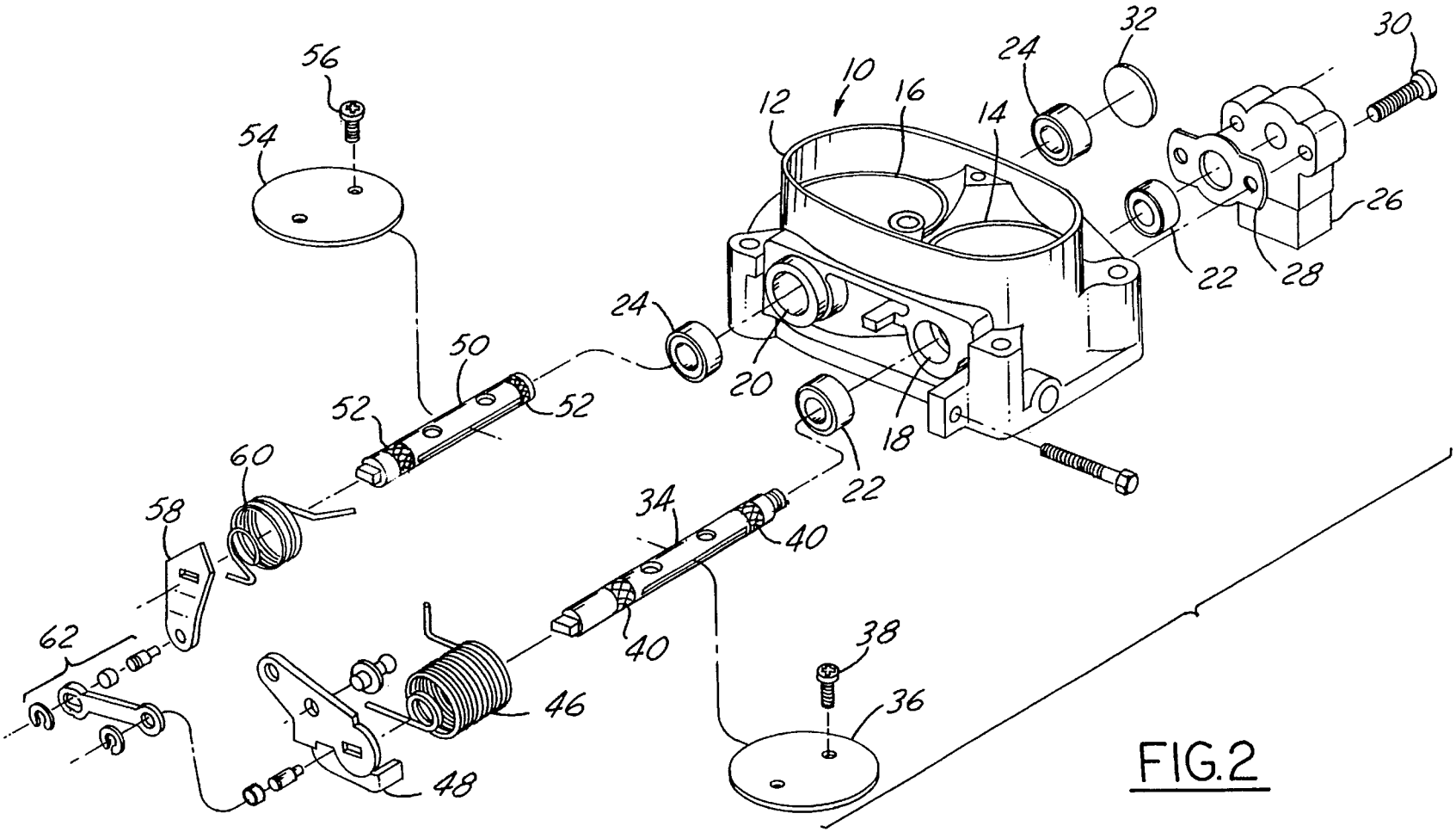
FIG. 2 is an exploded perspective view of the throttle body of FIG. 1, shown without sealant on the throttle shafts.

In the exemplary embodiment disclosed in FIGS. 1 and 2, the throttle body 10 includes a secondary air bore 16 as disclosed above, and thus includes a secondary throttle shaft 50. The secondary throttle shaft 50 mounts within the throttle shaft bearings 24 and includes mounting surfaces 52 that align with bearings 24 and will also be coated with a sealant. A secondary throttle plate 54 is secured in a slot in secondary throttle shaft 50 by screws 56. A conventional secondary throttle lever 58 and secondary throttle return spring 60 are coupled to the secondary throttle shaft 50 and secured thereto with conventional mounting hardware 62, forming a secondary throttle shaft assembly 64.

Of course, one skilled in the art would understand that a throttle shaft as disclosed in the present example of the best mode can also be used in a typical throttle body with just one air bore, and one corresponding throttle plate and shaft.

Figure 5:
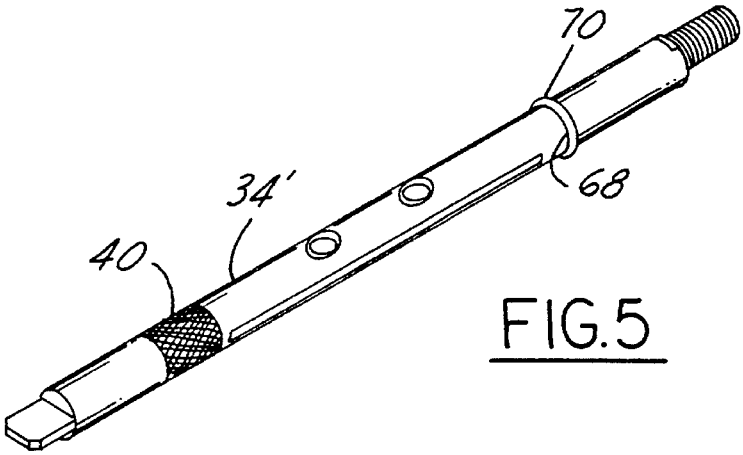
FIG. 5 is a perspective view similar to FIG. 3 illustrating an alternate embodiment of the present invention.

An alternate embodiment is illustrated in FIG. 5. This embodiment is the same as the first embodiment as illustrated in FIGS. 1–4, except for a change to the primary throttle shaft. The elements that have been modified from the first embodiment are given an added prime. In this embodiment, the primary throttle shaft 34' mounts within throttle shaft bearings 22 and couples to the throttle position sensor 26 the same as in the first embodiment. However, the throttle shaft 34' only includes a mounting surface 40 at the bearing location that will mount closest to the primary throttle control lever 48.

The other mounting surface location is replaced with a circumferential groove 68 formed in the shaft with an O-ring 70 mounted within the groove 68. This O-ring will align with the ocher throttle shaft bearing 22. In this way, the throttle shaft 34' can still be reduced in diameter without weakening the throttle shaft 34' too much. This is because most of the bending stress in the throttle shaft 34' is caused by a conventional throttle cable, not shown, that engages the primary throttle control lever 48 and pulls on it. The stress is thus higher in the throttle shaft 34' at the bearing 22 that is closer to the control lever 48 than it is at the other bearing. Therefore, the groove 68 is not at the location of peak stress and the diameter of the throttle shaft 34' can be reduced without becoming to weak. Further, the sealant 42 at the one bearing 22 will still limit the axial movement of the throttle shaft 34'.

While certain embodiments of the present invention have been described in detail, those Familiar with the art to which this invention relates will recognize various alternative designs and embodiments for practicing the invention as defined by the following claims.

We claim:

1. A throttle body for use in an air intake system of an internal combustion engine comprising:

a throttle body housing including an air flow bore and a throttle shaft mounting bore therethrough;

bearings mounted within the throttle shaft mounting bore;

a throttle shaft having a mounting surface thereabout aligned with at least one of the bearings;

sealing means, located between the mounting surface and the at least one of the bearings, for filling any gap that may exist between the mounting surface and the corresponding bearing and for substantially eliminating axial movement between them.

2. The throttle body of claim 1 wherein the bearings mounted within the throttle shaft comprise two bearings and the throttle shaft includes two mounting surfaces, one aligned with each of the bearings respectively, with the sealing means located between each of the mounting surfaces and its corresponding bearing.

3. The throttle body of claim 2 wherein the sealing means comprises a liquid sealant hardened between the throttle shaft and the at least one bearing.

4. The throttle body of claim 3 wherein the mounting surface comprises knurls formed into the surface of the throttle shaft.

5. The throttle body of claim 4 further including a throttle position sensor coupled to the throttle shaft.

6. The throttle body of claim 1 further including a throttle position sensor coupled to the throttle shaft.

7. The throttle body of claim 1 wherein the mounting surface comprises knurls formed into the surface of the throttle shaft.

8. The throttle body of claim 1 wherein the sealing means comprises a liquid sealant hardened between the throttle shaft and the at least one bearing.

9. The throttle body of claim 1 wherein the throttle shaft includes a recess circumferentially located about its surface and an O-ring secured within the recess, and the bearings are two bearings with the mounting surface aligned with one of the bearings and the O-ring aligned with the other of the bearings.

10. The throttle body of claim 9 wherein the sealing means comprises a liquid sealant hardened between the throttle shaft and the at least one bearing.

11. The throttle body of claim 1 further comprising:

a second air flow bore and a corresponding second throttle shaft mounting bore through the throttle body housing;

a second set of bearings mounted within the second mounting bore;

a second throttle shaft having a second mounting surface aligned with at least one of the bearings in the second set of bearings; and second sealing means, located between the mounting surface on the second throttle shaft and the at least one of the second bearings, for filling any gap that may exist between the mounting surface and the corresponding second bearing and for substantially eliminating axial movement between them.

12. A throttle body for use in an air intake system of an internal combustion engine comprising:

a throttle body housing including an air flow bore and a throttle shaft mounting bore therethrough;

two bearings mounted within the throttle shaft mounting bore:

a throttle shaft having two mounting surfaces thereabout, each one of the mounting surfaces aligned with a different one of the bearings;

sealant, located between each of the mounting surfaces and its corresponding bearing.

13. The throttle body of claim 12 wherein the two mounting surfaces comprise knurls formed into the surface of the throttle shaft.

14. The throttle body of claim 12 further comprising:

a second air flow bore and a corresponding second throttle shaft mounting bore through the throttle body housing;

a second pair of bearings mounted within the second mounting bore;

a second throttle shaft having two second mounting surfaces, each one of the second mounting surfaces aligned with a different one of the bearings in the second pair of bearings; and sealant, located between each of the mounting surfaces on the second throttle shaft and its corresponding second bearing.

15. A throttle body for use in an air intake system of an internal combustion engine comprising:

a throttle body housing including an air flow bore and a throttle shaft mounting bore therethrough;

two bearings mounted within the throttle shaft mounting bore;

a throttle shaft having a mounting surface thereabout aligned with at least one of the two bearings, and a recess circumferentially located about its surface, and an O-ring secured within the recess aligned with the other of the two bearings;

sealant, located between the mounting surface and the at least one of the two bearings.

* * * * *